United States Patent [19]

Ichijima et al.

[11] Patent Number: 4,837,136

[45] Date of Patent: Jun. 6, 1989

[54] SILVER HALIDE PHOTOGRAPHIC MATERIALS COMPRISING NON-DIFFUSIBLE PHOTOGRAPHICALLY USEFUL COMPOUNDS

[75] Inventors: Seiji Ichijima; Yasuhiro Shimada; Jun Arakawa, all of Kanagawa, Japan

[73] Assignee: Fuji Photo Film Co., Ltd., Kanagawa, Japan

[21] Appl. No.: 917,133

[22] Filed: Oct. 9, 1986

[30] Foreign Application Priority Data

Oct. 9, 1985 [JP] Japan ..... 60-225177

[51] Int. Cl.[4] ..... G03C 7/32; G03C 7/34

[52] U.S. Cl. ..... 430/543; 430/544; 430/546; 430/553; 430/566; 430/603; 430/636; 430/956; 430/937; 430/958

[58] Field of Search ..... 430/546, 227, 636, 566, 430/544, 543, 553, 603, 956, 957, 958

[56] References Cited

U.S. PATENT DOCUMENTS 3,963,499 6/1976 Shiba et al. ..... 430/546

4,138,258 2/1979 Hirose et al. ..... 430/562

*Primary Examiner*—Paul R. Michl

*Assistant Examiner*—Patrick A. Doudy

*Attorney, Agent, or Firm*—Sughrue, Mion, Zinn, Macpeak, and Seas

[57] ABSTRACT

A silver halide photographic material is described comprising a support having coated thereon at least one silver halide emulsion layer, wherein at least one of the silver halide emulsion layer and other hydrophilic colloid layer contains a nondiffusible photographically useful compound having a sulfo group and a group represented by the following general formula (I):

(I)

wherein $R_1$ and $R_2$ each represents an aliphatic group having at least 2 carbon atoms and r represents 0 or 1.

The compounds represented by the general formula (I) are photographically useful compounds which impart excellent photographic properties to silver halide photographic materials, including improved dispersibility.

8 Claims, No Drawings

SILVER HALIDE PHOTOGRAPHIC MATERIALS COMPRISING NON-DIFFUSIBLE PHOTOGRAPHICALLY USEFUL COMPOUNDS

FIELD OF THE INVENTION

This invention relates to a silver halide photographic material containing photographically useful compound(s) having excellent dispersibility.

BACKGROUND OF THE INVENTION

A color photographic light-sensitive material for a subtractive color process comprises hydrophilic colloid layer(s) containing photographically useful compound(s) on a support.

Such photographically useful compounds include image-forming couplers, colored couplers, development inhibitor releasing couplers, fading prevention agents, antifoggants, ultraviolet absorbents, photographic dyes, color mixing prevention agents, etc. These compounds as used in photographic layers exist in nondiffusible forms, i.e., these compounds are rendered nondiffusible by a nondiffusible group composed of a relatively large organic atomic group. By rendering the compound nondiffusible, the compound added to a photographic layer is immobile in that layer and shows a photographically effective function therein.

However, by uniformly dispersing such a nondiffusible compound in a hydrophilic colloid layer such as a silver halide emulsion layer, many problems arise.

For example, when using a compound having a salt-forming group such as a sulfo group in the molecule, a method of dispersing this compound in a silver halide emulsion as a solution in neutral water is used. In this case, however, a compound having a nondiffusible group causes a problem due to its low solubility in water. Also, in a method of dispersing the compound in a silver halide emulsion as a solution in a high boiling organic solvent, the above-described compound having a salt-forming group causes a problem due to its low solubility in the organic solvent.

Accordingly, various nondiffusible groups for improving the solubility of these compounds having such groups have been proposed. For example, certain nondiffusible compounds which somewhat resemble the compounds of this invention are described in U.S. Pat. No. 3,892,576 and Japanese Patent Publication No. 16058/74 (5-pyrazolone couplers having an $\alpha$-position branched type aliphatic carbonamido group). However, the compounds described in these references are dispersed in a silver halide emulsion as a solution in a high boiling organic solvent. On the other hand, compounds having a salt-forming group having a low solubility in an organic solvent are required to be dispersed as a solution in water, but nondiffusible groups which are highly effective in such a case have scarcely been known.

SUMMARY OF THE INVENTION

An object of this invention is to provide a silver halide photographic material having excellent photographic properties comprising photographically useful compound(s) having improved dispersibility.

It has now been discovered that the above object can be attained by a silver halide photographic material comprising a support having coated thereon at least one silver halide emulsion layer, wherein at least one of the silver halide emulsion layer and other hydrophilic colloid layer contains a nondiffusible photographically useful compound having a sulfo group and a group represented by the following general formula (I):

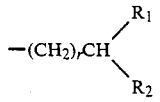

(I)

wherein $R_1$ and $R_2$ each represents an aliphatic group having at least 2 carbon atoms and r represents 0 or 1.

DETAILED DESCRIPTION OF THE INVENTION

The invention is explained below in detail.

The photographically useful compounds of the present invention include image-forming couplers, color correction couplers (colored couplers), development inhibitor releasing couplers (DIR couplers), color mixing prevention agents, competing compounds, antifoggants, fading prevention agents, ultraviolet absorbents, dyes, stain preventing agents, etc.

The competing compound means a scavenger for an oxidized product of a developing agent, specific examples of which include a competing coupler (that is, a coupler which reacts with the oxidized product of a developing compound but forms no dye) and a compound which reduces the oxidized product of a developing agent and inhibits a coupling reaction with a coupler (such as a hydroquinone derivative, etc.).

The above-described compounds for use in this invention are added to silver halide emulsion layers or other hydrophilic colloid layers such as gelatin-containing layers and are required to be rendered nondiffusible by a nondiffusible group. The term "nondiffusible group" means an organic group which increases the molecular size of a compound in order to make the compound substantially nondiffusible from the layer in which the compound is incorporated. The compounds for use in this invention are rendered nondiffusible by the group represented by general formula (I) described above, but may further have nondiffusible groups at other optional positions of the molecule. Specifically, in the latter case, the group represented by general formula (I) can be used together with other known nondiffusible groups.

When a compound is rendered nondiffusible by the presence of $R_1$ and $R_2$ of the group represented by general formula (I), it is preferred that the sum of the carbon atoms contained in $R_1$ and $R_2$ is 10 to 30.

The aliphatic group represented by $R_1$ and $R_2$ in the above-described general formula (I) may be a saturated or unsaturated, straight chain, branched or cyclic, substituted or unsubstituted aliphatic group. Examples thereof are an ethyl group, a butyl group, a hexyl group, an octyl group, a methyl group, a 1,3,3-trimethylbutyl group, a 3,5,5-trimethylhexyl group, a dodecyl group, or a cyclohexyl group. These aliphatic groups are preferably unsubstituted, but may have a substituent. Typical examples of this substituent include an aryl group, a halogen atom, an alkoxy group (e.g., a methoxy group, a butoxy group, etc.), an alkyl-thio group (e.g., a butylthio group, an octylthio group, etc.), an aryloxy group (e.g., a 4-amylphenoxy group, a phenoxy group, etc.), a hydroxy group, a carboxy group, a sulfo group, etc.

Preferred embodiments of this invention are described hereafter.

The photographically useful compounds for use in this invention are preferably image-forming couplers, color correction couplers (colored couplers), development inhibitor releasing couplers (DIR couplers), color mixing prevention agents, and competing compounds.

Image-forming couplers used as the photographically useful compounds in this invention include yellow couplers (e.g., open chain ketomethylene type couplers, etc.), magenta couplers (e.g., 5-pyrazolone type couplers, pyrazoloimidazole type couplers, pyrazolotriazole type couplers, etc.), cyan couplers (e.g., phenyl type couplers, naphthol type couplers, etc.), black coloring couplers (e.g., resorcin type couplers, etc.), and colorless compound-forming couplers (e.g., indanone type couplers, acetophenone type couplers, etc.).

Color correction couplers preferably include the image-forming couplers illustrated above, each having an arylazo group at the coupling position of the coupler or having a water-soluble dye portion in the structure of a releasing group. Development inhibitor releasing couplers preferably include the above-illustrated image-forming couplers, each having a development inhibitor or a precursor thereof at the coupling position of the coupler.

Preferred examples of the color mixing prevention agent and the competing compound for use in this invention are hydroquinones, sulfonamidophenols, naphthohydroquinones, pyrogallols, catechols, etc.

The couplers (i.e., image-forming couplers, colored couplers, and DIR couplers), color mixing prevention agents, and competing compounds illustrated above, which are preferably used as the photographically useful compounds in this invention, each contains the group represented by the general formula (I) and a sulfo group at substitutable positions.

Preferred examples of the above-described compounds for use in this invention are represented by the following general formula (II):

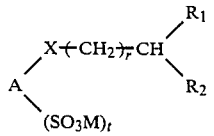

(II)

wherein $R_1$, $R_2$ and r are the same as defined above with respect to the general formula (I); A represents a component or a moiety capable of reacting with the oxidation product of a developing agent; X represents —O—, —S—, $$-COO-,\ -SO_2O-,\ -\underset{\underset{R_3}{|}}{CON}-,\ -\underset{\underset{R_3}{|}}{SO_2N}-,$$

$$-SO_2-,\ -\underset{\underset{R_3}{|}}{NCOO}-,\ -\underset{\underset{R_3}{|}}{N}\underset{\underset{R_4}{|}}{CON}-,\ \text{or}\ -\underset{\underset{R_3}{|}}{N}-$$

(wherein $R_3$ and $R_4$ each preferably represents a hydrogen atom but may also represent an aliphatic group having 1 to 30, preferably 1 to 10 carbon atoms), or a chemical bond; M represents a hydrogen atom or a cation such as an alkali metal ion, an ammonium ion, etc.; and t represents an integer of from 1 to 3.

More specifically, A in the above general formula (II) is a group containing a component for forming the couplers, competing compounds, and color mixing prevention agents in the photographically useful compounds explained above, that is, a component or moiety containing a group causing a coupling reaction with the oxidation product of a developing agent or a group reducing the oxidation product of a developing agent. X and $SO_3M$ are bonded to A at the substitutable positions.

Also, when the nondiffusible group in the general formula (II) is represented by

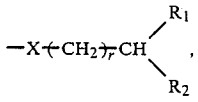

the sum of the carbon atoms contained in this group is preferably 14 to 30.

When the nondiffusible group in the general formula (II) is included in A, the sum of the carbon atoms contained in A is preferably 16 to 30.

Furthermore, the particularly preferred examples of the above-described compounds for use in this invention are those represented by the following general formula (III), (IV) and (V). These compounds exhibit a high reaction rate with the oxidation product of a developing agent:

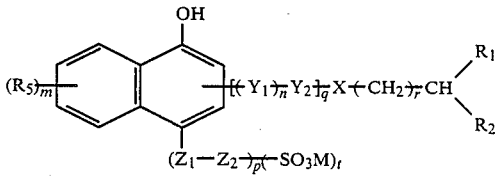

(III)

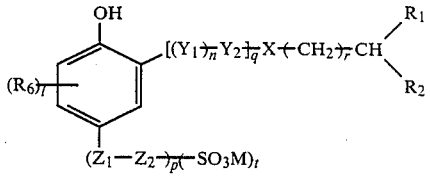

(IV)

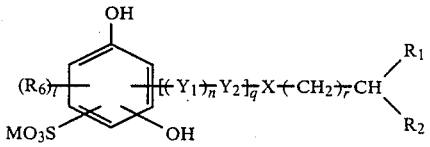

(V)

wherein $R_1$, $R_2$, X, t, r, and M are the same as defined with respect to the general formula (II); $Y_1$ is the same as X; $Y_2$ represents a divalent aliphatic group or a divalent aromatic group; n represents 0 or 1; q represents 0, 1, or 2; when q is 2, $Y_1$ and $Y_2$ each may be the same or different; $Z_1$ represents —O—, —S—, —N=N, or

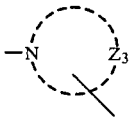

(wherein $Z_3$ represents an organic atomic group necessary for forming a 5-membered or 6-membered nitrogen-containing heterocyclic ring such as a pyridine ring, an imidazole ring, etc.); $Z_2$ represents an aliphatic group or an aromatic group; p represents an integer of 1 to 3; when p is 2 or 3, $Z_1$ and $Z_2$ each may be the same or different; $R_5$ represents a group substituted at the aromatic ring and preferably represents $R_7$—CONH—, $R_7$—$SO_2$NH—, $R_7$—OCONH—, $R_7$—NHCONH— or $R_7$—$NHSO_2$NH— (wherein $R_7$ represents an aliphatic group, an aromatic group or a heterocyclic group); m represents O or an integer of 1 to 4; preferably 0, 1 or 2; when m is more than 1, $R_5$ may be the same or different; $R_6$ represents a group substituted at the aromatic ring, and preferably represents a halogen atom, $R_7$—, $R_7$—CO—, HO—, $R_7$—O—, $R_7$—CONH—, $R_7$—$SO_2$NH—, $R_7$—OCONH—, $R_7$—NHCONH—, $R_7$—S—, $R_7$—$SO_2$—, $R_7$—NHCO—, $R_7$—OCO—, $R_7$—$NHSO_2$— (wherein $R_7$ has the same meaning as defined above) or a carboxy group; and l represents 0, 1 or 2; when l is 2, $R_6$ may be the same or different.

When $Y_2$, $R_5$, $Z_2$ and $R_6$ in the above general formulae each contains an aliphatic group, these aliphatic groups each may be a straight chain, branched or cyclic, saturated or unsaturated, substituted or unsubstituted group having 1 to 30 carbon atoms.

When $Y_2$, $R_5$, $Z_2$ and $R_6$ each contains an aromatic group, the carbon atom number thereof is 6 to 30, preferably 6 to 10.

Particularly preferred ranges in the general formulae (III), (IV) and (V) described above are set forth below.

The sum of the carbon atoms contained in the formula

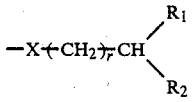

is preferably in the range of 14 to 30.

In the general formula (III) and (IV), q and n are preferably 1.

In the general formula (III), $Y_1$ is preferably —CONH— ($Y_2$ is bonded to the right side thereof).

In the general formula (IV), $Y_1$ is preferably —NHCO— or —NHCONH— ($Y_2$ is bonded to the right side thereof).

In the general formula (III), m is preferably 0 or 1 and the position to which $R_5$ is substituted is preferably the 5-position of the naphthol ring.

In the general formulae (III) and (IV), $Z_2$ to which (t) $SO_3M$ groups are bonded is preferably an aromatic group.

In the general formulae (III), (IV) and (V), X is preferably —O—, —S—, —NHCO—, —OCO—, or —COO— (to the right side of which is bonded

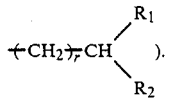

The compounds which provide the most excellent effects in the practice of this invention of the compounds represented by the general formulae (III), (IV) and (V) are the compounds shown by the general formulae (III) and (IV), wherein one of (p) $Z_1$'s is —N=N—.

The preferred addition amount of the photographically useful compounds for use in this invention depends upon the kind of the compound employed, but is usually about $10^{-8}$ to about $10^{-1}$ mol per mol of silver existing in the same layer containing the compound or an adjacent layer thereto for the antifoggant or the development inhibitor, about $10^{-6}$ to about $10^{-1}$ mol per mol of silver for a mercapto series antifoggant, about $10^{-5}$ to about $10^{-1}$ mol per mol of silver for an azole series antifoggant such as a benzotriazole series antifoggant, about $10^{-2}$ to about 10 mol, preferably 0.1 to 5 mol, per mol of silver for a developing agent, about $10^{-4}$ to about 10 mol, preferably $10^{-2}$ to 5 mol, per mol of silver for a pyrazolidone series auxiliary developing agent, about $10^{-6}$ to about $10^{-2}$ mol, preferably $10^{-5}$ to $10^{-3}$ mol, per mol of silver for a fogging agent, about $10^{-3}$ to about 10 mol, preferably $10^{-2}$ to 1 mol, per mol of silver for a silver halide solvent, about $10^{-5}$ to about $10^{-1}$ mol, preferably $10^{-4}$ to $10^{-2}$ mol, per mol of silver for a bleach accelerating agent, and about $10^{-3}$ to about 1 mol, preferably $5\times10^{-3}$ to 0.5 mol, per mol of silver for a dye or a coloring material for color diffusion transfer photography.

When the photographically useful compound for use in this invention is a dye-forming coupler, the addition amount thereof is in the range of about 0.001 to about 1 mol, preferably 0.01 to 0.5 mol, per mol of silver halide existing in the same layer containing the compound or an adjacent layer thereto. In the case of a colored coupler, the addition amount thereof is in the range of about 0.005 to about 2 mol, preferably 0.02 to 0.5 mol, per mol of a so-called main coupler which bears the major part of dye image density existing in the same layer containing the colored coupler or an adjacent layer thereto. In the case of a DIR compound, the coating amount thereof is in the range of about $10^{-8}$ to about $10^{-2}$ mol/m$^2$, preferably $10^{-6}$ to $10^{-4}$ mol/m$^2$.

Specific examples of the photographically useful compound for use in this invention are illustrated below, but the compounds contemplated for use in this invention are not limited to these examples.

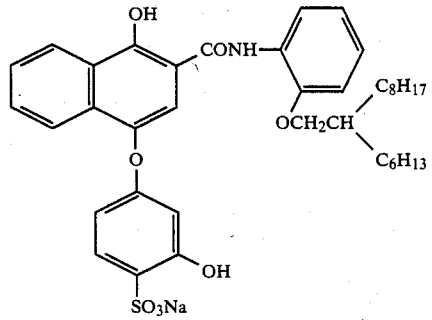

(1)

-continued
(2)
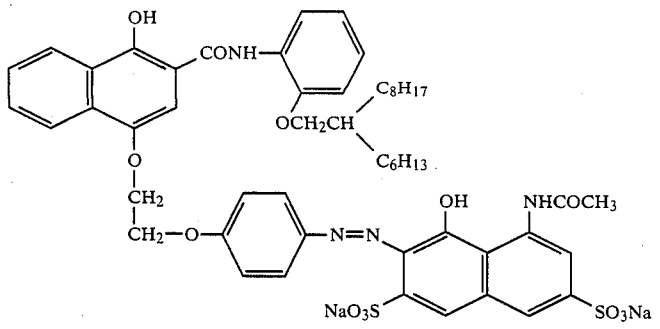
(3)
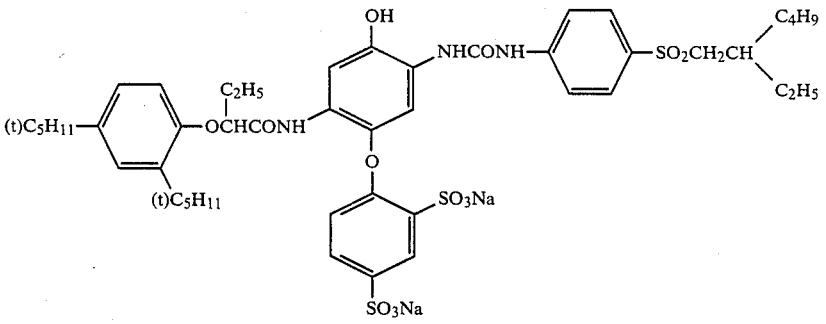
(4)
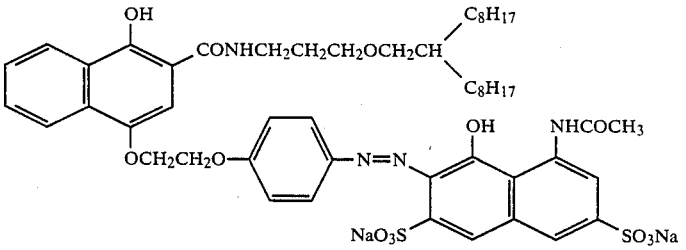
(5)
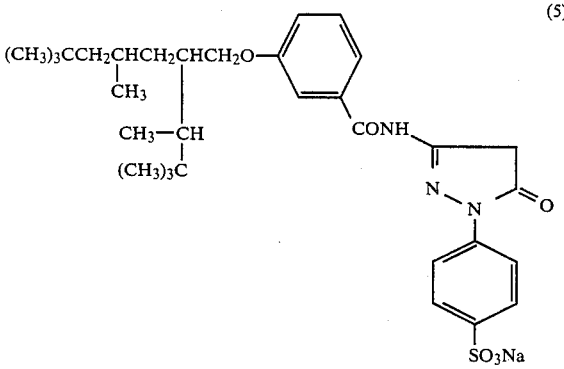
(6)
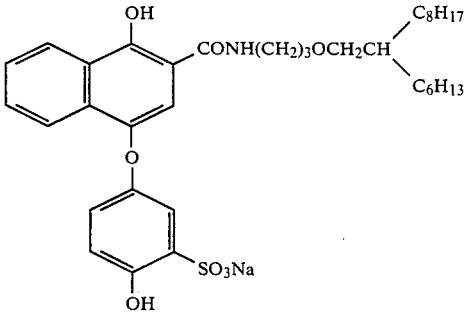

-continued
(7)
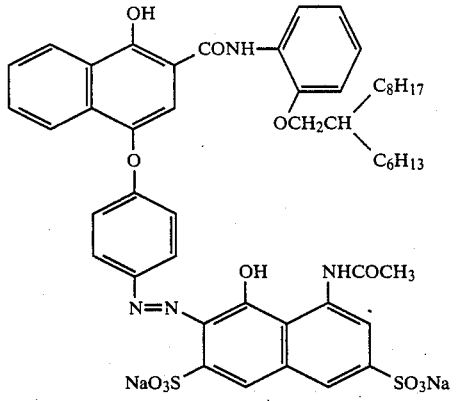
(8)
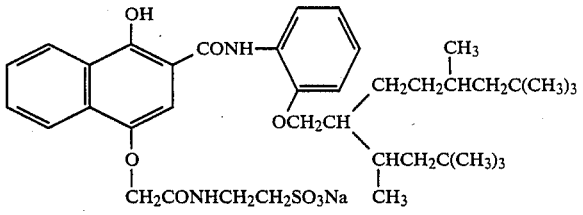
(9)
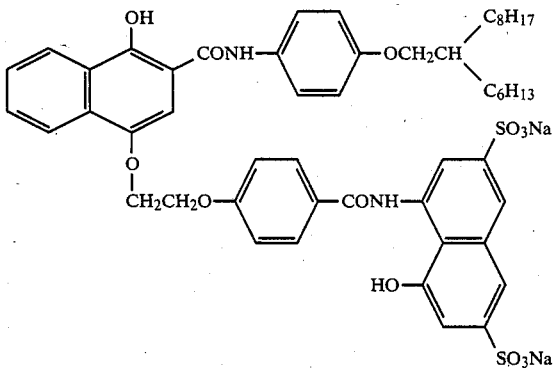
(10)
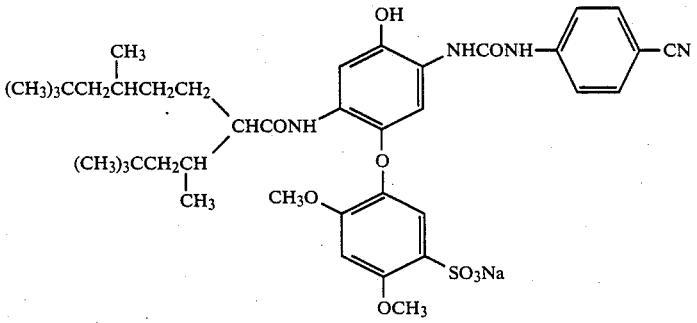

-continued
(11)
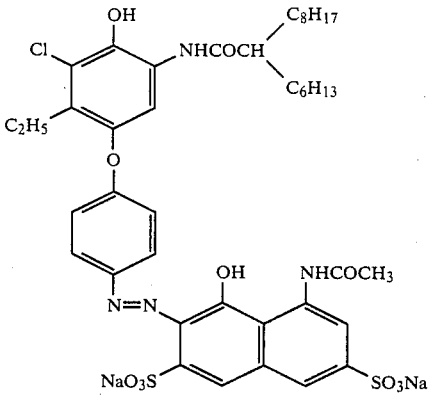
(12)
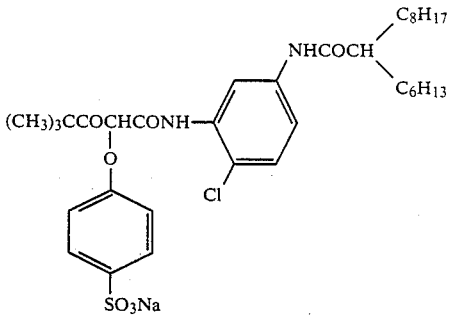
(13)
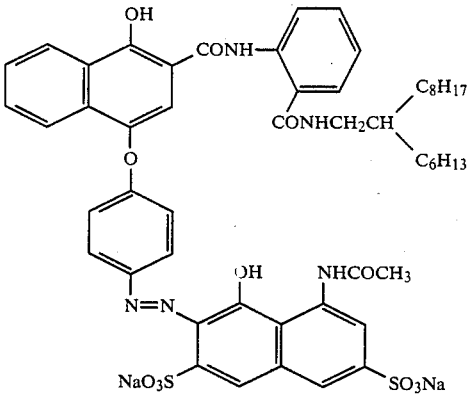
(14)
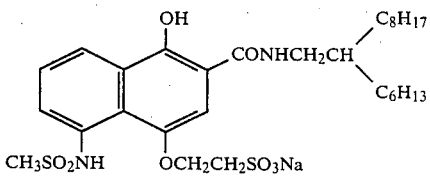
(15)
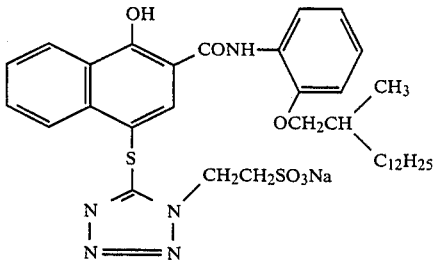
(16)
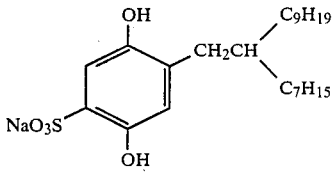
(17)
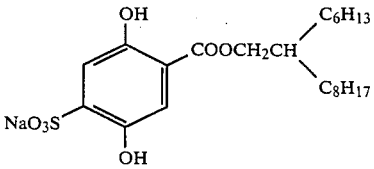
(18)
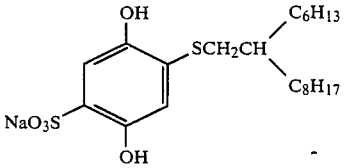
(19)
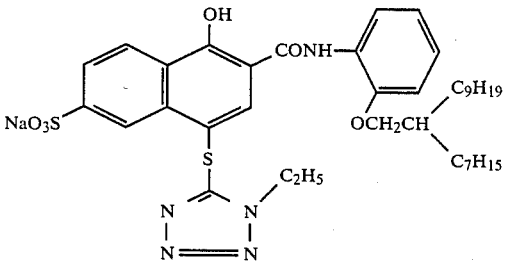
(20)
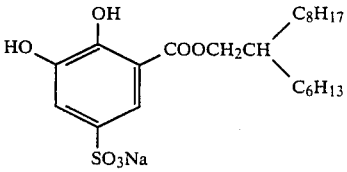

-continued (21)

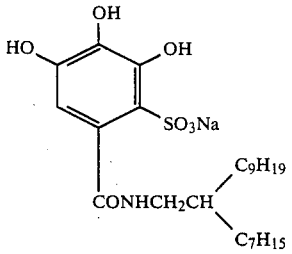

(22)

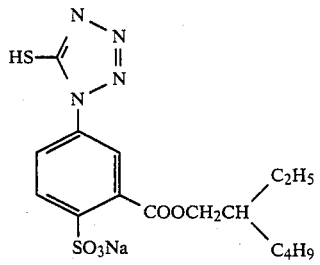

(23)

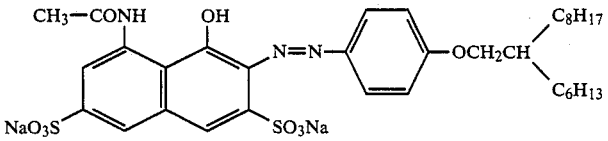

(24)

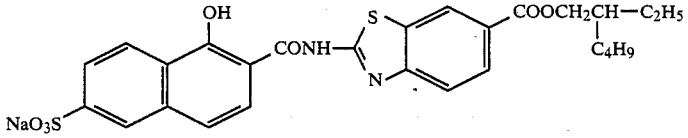

(25)

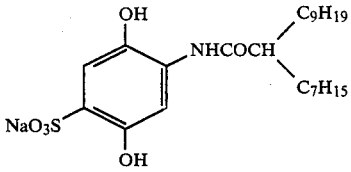

(26)

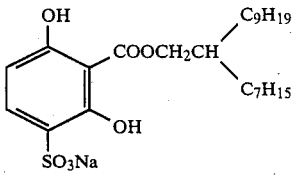

(27)

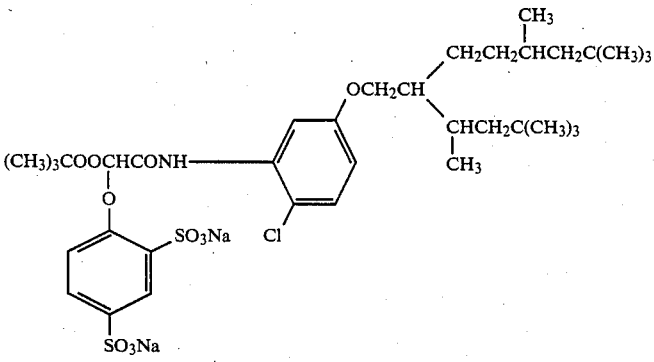

(28)

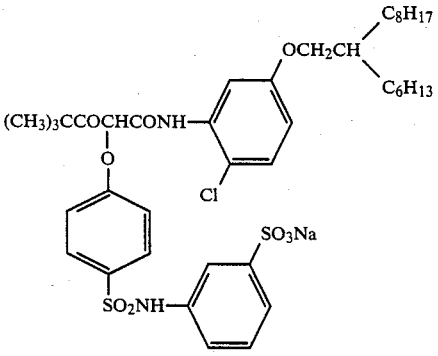

(29)

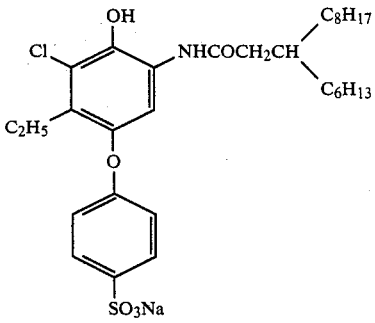

Practical methods of synthesizing the specific photographically useful compounds for use in this invention are illustrated below, but it is understood that other compounds within the scope of the present invention can be also synthesized by similar methods.

SYNTHESIS OF COMPOUND (2)

Compound (2) shown below was synthesized by the following synthesis route. A more detailed explanation of each reaction step follows.

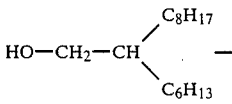
Compound 1
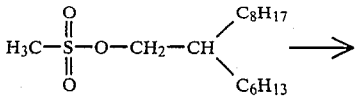
Compound 2
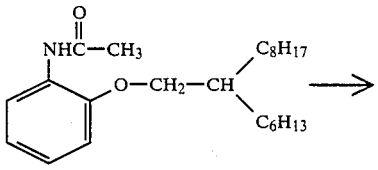
Compound 3
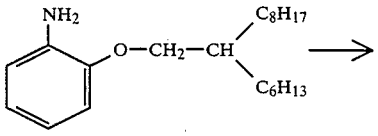
Compound 4
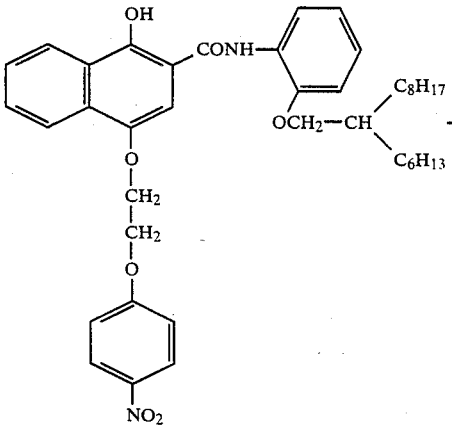
Compound 5
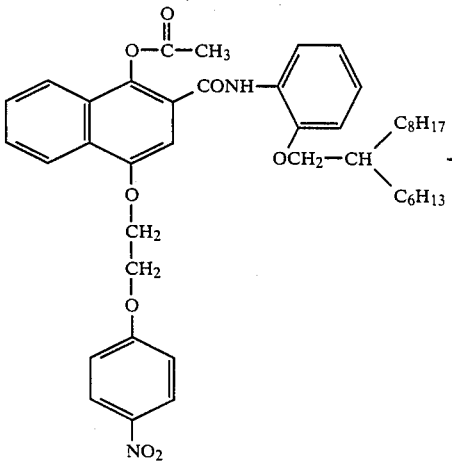
Compound 6
-continued
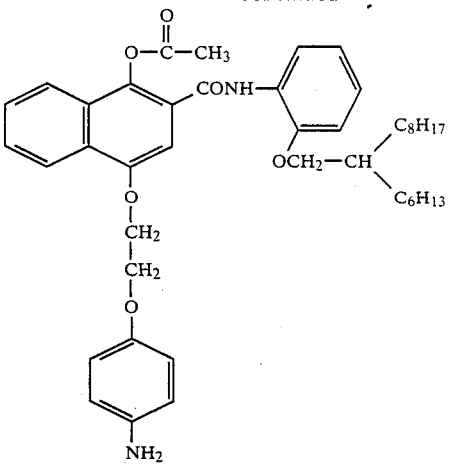
Compound 7
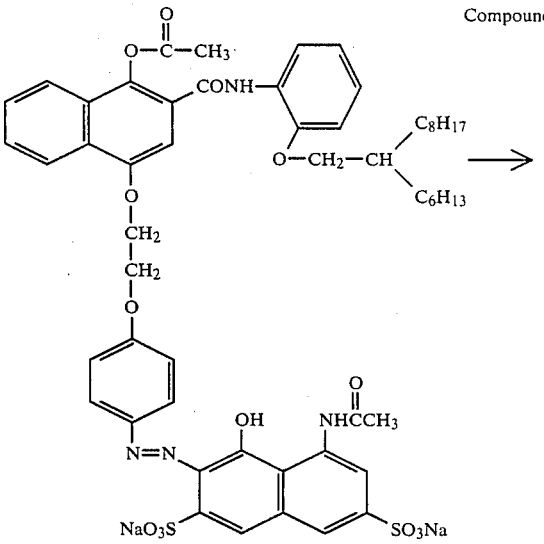
Compound 8
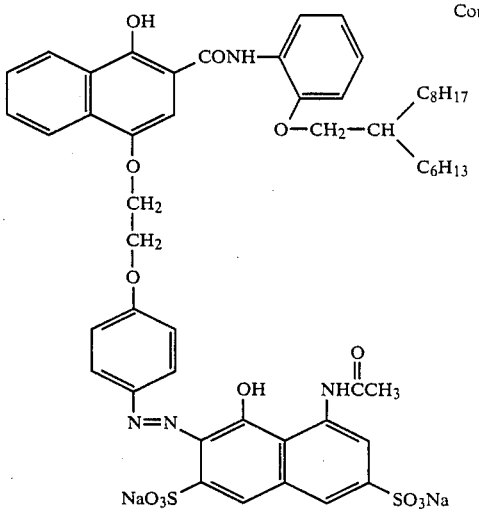
Compound (2)
STEP (1)
Synthesis of Intermediate Compound 2
118.0 g of methyl chloride was added dropwise at room temperature to a solution of 100.0 g of Compound 1 shown above in 81.5 g of pyridine. After the reaction was completed, the precipitates thus formed were filtered off, and 500 ml of ethyl acetate was added to the filtrate followed by washing with water. The organic layer thus formed was separated and the solvent was distilled off under reduced pressure to provide 130.0 g of Compound 2.

STEP (2)

Synthesis of Intermediate Compound 3

60.0 g of 2-acetylaminophenol, 127.3 g of Compound 2 and 82.3 g of potassium carbonate were added to 700 ml of N,N-diemthylformamide, and the resulting mixture was stirred for 4 hours at 80° C. After the reaction was completed, the reaction mixture was filtered and after adding 500 ml of ethyl acetate to the filtrate thus obtained, the mixture was washed with water. The organic layer thus formed was separated and the solvent was distilled off under reduced pressure to provide 155.0 g of Compound 3.

STEP (3)

Synthesis of Intermediate Compound 4

100 ml of hydrochloric acid was added to 600 ml of an ethanol solution of 155.0 g of Compound 3, and the mixture was refluxed with heatin for 8 hours. After the reaction was completed, ethanol was distilled off, and after adding 500 ml of ethyl acetate to the residue, the mixture was washed with water. The organic layer thus formed was separated and the solvent was distilled off under reduced pressure to provide 120.9 g of Compound 4.

STEP (4)

Synthesis of Intermediate Compound 5

A mixture of 45.8 g of Compound 4 and 60.0 g of 1-hydroxy-4-[2-(4-nitrophenoxy)ethoxy]-2-naphthoic acid phenyl ester was maintained at 140° C. to 150° C. and, after melting, the mixture was stirred for 5 hours. After the reaction was completed, to the reaction mixture was added a mixed solvent comprising 20 ml of ethyl acetate and 200 ml of hexane followed by stirring to precipitate crystals, which were collected by filtration and dried to provide 72.0 g of Compound 5.

STEP (5)

Synthesis of Intermediate Compound 6

After adding 4.62 g of acetic anhydride and 3.59 g of pyridine to 27.0 g of Compound 5, the mixture was stirred for 1 hour at room temperature. After the reaction was completed, 300 ml of ethyl acetate was added to the reaction mixture followed by washing with water. The organic layer thus formed was separated and the solvent was distilled off under reduced pressure to provide 28.4 g of Compound 6.

STEP (6)

Synthesis of Intermediate Compound 7

33.83 g of Compound 6, 24.57 g of reduced iron, 3.4 g of ammonium chloride and 3.4 ml of acetic acid were added to a mixed solvent of 100 ml of isopropanol and 35 ml of water, and the resulting mixture was refluxed with heating for 1 hour. The reaction mixture was filtered while it was hot, and after adding 300 ml of ethyl acetate to the filtrate thus formed, the mixture was washed with water. The organic layer thus formed was separated and the solvent was distilled off under reduced pressure to provide 28.2 g of Compound 7.

STEP (7)

Synthesis of Intermediate Compound 8

To 200 ml of a methyl cellosolve solution of 28.2 g of Compound 7 was added 9.5 ml of an aqueous solution of 36% hydrochloric acid, and further, 3.2 g of sodium nitrite dissolved in 15 ml of water was added dropwise to the solution at 0° C. The diazonium salt thus formed was added dropwise to 200 ml of a dimethyl-formaldehyde solution comprising 16.4 g of an aqueous potassium acetate solution and 20.0 g of H acid monoacetyl followed by stirring. After the reaction was completed, 600 ml of acetonitrile was added to the reaction mixture to precipitate crystals, which were collected by filtration and dried to provide 44.0 g of Compound 8.

STEP (8)

Synthesis of Compound (2)

After stirring 500 ml of an aqueous methanol solution containing 44.0 g of Compound 8 prepared above and 64.1 g of potassium hydroxide for 1.5 hours at 40° C. to 50° C., 65 ml of acetic acid was added to the reaction mixture thus obtained and the mixture was neutralized to precipitate crystals. The crsytals were collected by filtration and dried to provide 25.8 g of Compound (2).

Methods for introducing the photographically useful compound for use in this invention into a light-sensitive material are generally classified into following three methods:

(1) The compound for use in this invention is dissolved in water under heating (about 75° C.) and is added to a hydrophilic colloid solution as an aqueous solution.

(2) The Compound for use in this invention is similarly dissolved in water under heating using a surface active agent and then added to a hydrophilic colloid solution as an aqueous solution.

(3) Water is previously dispersed in a water-immiscible low boiling organic solvent (the water-immiscible solvent is selected from the organic solvents shown hereinbelow as coupler dispersing auxiliary solvents), and the compound for use in this invention is dissolved in the dispersion with heating and, if necessary, after a coupler dispersing high boiling organic solvent described hereinbelow is added thereto, the resulting mixture is dispersed in a hydrophilic colloid solution using a surface active agent. In this case, it is preferred that the proportion of water to the above-described low boiling organic solvent is in the range of about 10 to about 80% by weight.

The method of addition of the compound to a light-sensitive material can be properly selected according to the function, property and/or the purpose of the compound to be used.

The couplers which can be used in the photographic light-sensitive materials of this invention as photographically useful compounds can be introduced into the light-sensitive materials by various dispersion methods, such as a solid dispersion method or an alkali dispersion method, as described, for example, in British Patents 455,556 and 465,823. A latex dispersion method is preferred, however, and even more preferred is an oil drop in water dispersion method. In the oil drop in water dispersion method, the coupler is dissolved in a high boiling organic solvent having a boiling point of at least about 175° C. and/or a so-called auxiliary organic solvent having a low boiling point, and then this solution is finely dispersed in an aqueous medium such as water on an aqueous gelatin solution in the presence of a surface active agent. Examples of the high boiling organic solvent are described, for example, in U.S. Pat. No. 2,322,027, etc. The dispersion may be accompanied by a phase conversion and also, if necessary, after removing the auxiliary somewhat by distillation, noodle washing, ultrafiltration, etc., the dispersion may be used as a coating composition.

Specific examples of the high boiling organic solvent are phthalic acid esters (e.g., dibutyl phthalate, dicyclohexyl phthalate, di-2-ethylhexyl phthalate, decyl phthalate, etc.), phosphoric acid esters or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate, etc.), benzoic acid esters (e.g., 2-ethylhexyl benzoate, dodecyl benzoate, 2-ethylhexyl-p-hydroxy benzoate, etc.), amides (e.g., diethyldodecanamide, N-tetradecyl-pyrrolidone, etc.), alcohols or phenols (e.g., isostearyl alcohol, 2,4-di-tert-amylphenol, etc.), aliphatic carboxylic acid esters (e.g., dioctyl azelate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), etc.

Also, as the auxiliary organic solvent, organic solvents having a boiling point of higher than about 30° C., preferably 50° C. to 160° C. can be used. Specific examples of the auxiliary organic solvent are ethyl acetate, butyl acetate, ethyl propionate, methyl ethyl ketone, cyclohexanone, 2-ethoxyethyl acetate, dimethylformamide etc.

The latex dispersion methods, the effect thereof and specific latexes for impregnation are described in U.S. Pat. No. 4,199,363, West German patent application (OLS) Nos. 2,541,274 and 2,541,230.

The photographic emulsion layers of the photographic light-sensitive materials of this invention may comprise silver bromide, silver iodobromide, silver iodochlorobromide, silver chlorobromide, or silver chloride. A preferred silver halide for use in this invention is silver iodobromide or silver iodochlorobromide containing less than about 30 mol% silver iodide. A particularly preferred silver halide for use in this invention is silver iodobromide containing 2 mol% to 25 mol% silver iodide.

The silver halide grains in the photographic emulsions for use in this invention may have a regular crystal form such as a cube, an octahedron, a tetradecahedron, etc., or an irregular crystal form such as sphere. The silver halide grains may have a crystal defect such as twin crystals, etc., or further, they may have a composite form of the above-described crystal forms.

The silver halide grains may consist of fine grains of less than about 0.1 micron or may be large crystals having a diameter of a projected area up to about 10 microns.

The silver halide emulsion for use in this invention may be a monodispersed emulsion having a narrow grain size distribution of silver halide grains or a polydispersed emulsion having a wide grain size distribution.

The silver halide photographic emulsions for use in this invention can be produced by known methods as described, for example, in *Research Disclosure* (RD), No. 17643, pp. 22 and 23 (December, 1978), "Emulsion preparation and types", and *Research Disclosure,* No. 18716, page 648 (November, 1979).

More specifically, the silver halide photographic emulsions for use in this invention can be prepared by the methods described by P. Glafkides in *Chimie et Physique Photographique* (Paul Montel, 1967), G. F. Duffin, *Photographic Emulsion Chemistry* (Focal Press, 1966), V. L. Zelikman et al., *Making and Coating Photographic Emulsion* (Focal Press, 1964), etc. More specifically, the emulsions may be prepared by an acid method, a neutralization method, an ammonia method, etc. Methods for reacting a soluble silver salt or a soluble halide include a single jet method, a double jet method or a combination of these methods. A so-called reverse mixing method for forming silver halide grains in the presence of excessive silver ions can also be used. As one type of the above-mentioned double jet method, a so-called controlled double jet method for maintaining pAg in the liquid phase for forming silver halide at a constant level can be used. According to this method, a silver halide emulsion wherein the crystal form of the silver halide grains is regular and the grain size distribution of slver halide grains is almost uniform can be obtained.

Also, a mixture of 2 or more kinds of silver halide emulsions separately prepared by one of the above-described methods may be used.

A silver halide emulsion containing the above-described silver halide grains having a regular crystal form can be obtained by controlling the pAg and pH of the system during the formation of the silver halide grains. Details thereof are described, for example, in *Photographic Science and Engineering,* Vol. 6, pp. 159 to 165 (1962), *Journal of Photographic Science,* Vol. 12, pp. 242 to 251 (1964), U.S. Pat. No. 3,655,394, and British Pat. No. 1,413,748.

Further, a monodispersed silver halide emulsion may comprise a silver halide emulsion wherein the mean grain diameter (or size) of the silver halide grains is at least about 0.1 μm and at least about 95% by weight of the silver halide grains are in the range of the mean grain size ±40%. A silver halide emulsion wherein the mean grain size of the silver halide grains is about 0.25 to about 2 μm and at least 95% by weight or by number thereof is in the range of the mean grain size ±20% can also be used. The methods for producing these silver halide emulsions are described in U.S. Pat. Nos. 3,574,628 and 3,655,394 and British Pat. No. 1,413,748. Also, the preferred monidispersed silver halide emulsions for use in this invention are described in Japanese patent application (OPI) Nos. 8600/73, 39027/76, 83097/76, 137133/78, 48521/79, 99419/79, 37635/83, 49938/83, etc. (the term "OPI" as used herein refers to a "published unexamined Japanese patent application").

Also, tabular silver halide grains having an aspect ratio of at least 5 can be used in this invention. Tabular grain silver halide emulsions can be easily prepared by the methods described by Gutoff in *Photographic Science and Engineering,* Vol. 14, pp. 248 to 257 (1970), U.S. Pat. Nos. 4,434,226, 4,414,310, 4,433,048 and 4,439,520, British Pat. No. 2,112,157, etc. Where tabular silver halide grains are employed, advantages relating to improvement of the color sensitizing efficiency by sensitizing dye(s), improvement of graininess, and an increase of sharpness as described in the above-described U.S. Pat. No. 4,434,226, etc., can be obained.

The crystal structure of the silver halide may consist of a uniform halogen composition throughout the grain or may be different in halogen composition between the inside and the outside of the grain, or may further have a layer structure. Example of these silver halide grains are disclosed in British Pat. No. 1,027,146, U.S. Pat. Nos. 3,505,068 and 4,444,877, and Japanese patent application No. 248469/83 (corresponding to Japanese patent application (OPI) No. 14331/85), etc. Also, silver halide grains composed of epitaxially bonded silver halide each having a different halogen composition can be used in this invention, or silver halide grains bonded to compounds other than silver halides, such as silver rhodanate, lead oxide, etc., can also be used. Examples of these silver halide grains are disclosed in U.S. Pat. Nos. 4,094,684, 4,142,900, 4,459,353, British Pat. No. 2,038,792, U.S. Pat. Nos. 4,349,622, 4,395,478, 4,433,501, 4,463,087, 3,656,962, 3,852,067, Japanese patent application (OPI) No. 162540/84, etc.

Also, a mixture of silver halide grains having various crystal forms can be used.

The silver halide emulsions for use in this invention are usually physically ripened, chemically ripened, and spectrally sensitized. The additives which are used in the above-described steps are described in *Research Disclosure,* No. 17643 (RD 17643) and *Research Disclosure,* No. 18716 (RD 18716), and the corresponding portions thereof are summarized in the following table.

Also, other photographic additives which can be used in this invention are also described in the two above-cited references, and the corresponding portions thereof are also shown in the same table.

| Addition Materials | RD 17643 | RD 18716 |
|---|---|---|
| 1. Chemical Sensitizer | Page 23 | Page 648, right column |
| 2. Sensitivity Increasing Agent | | " |
| 3. Spectral Sensitizer & Supersensitizer | Pages 23 and 24 | Page 648, right column to page 649, right column |
| 4. Antifoggant & Stabilizer | Pages 24 and 25 | Page 649, right column |
| 5. Light Absorbent, Filter Dye, & Ultraviolet Absorbent | Pages 25 and 26 | Page 649, right column to page 650, left column |
| 6. Stain Preventing Agent | Page 25, right column | Page 650, left to right columns |
| 7. Hardening Agent | Page 26 | Page 651, left column |
| 8. Binder | Page 26 | " |
| 9. Plasticizer & Lubricant | Page 27 | Page 650, right column |
| 10. Coating Aid & Surface Active Agent | Pages 26 and 27 | " |
| 11. Antistatic Agent | Page 27 | " |

In this invention, various kinds of color couplers can be used, and specific examples thereof are described in the patents cited in the above-mentioned *Research Disclosure,* No. 17643, Sections VII-C to G. As dye-forming couplers, couplers forming the three primary colors (i.e., yellow, magneta and cyan) by a subtractive color process upon color development, and the nondiffusible 4-equivalent or 2-equivalent couplers practically described in *Research Disclosure,* No. 17643, Sections VII-C and VII-D, as well as the following couplers, can be preferably used in this invention.

Typical examples of the yellow couplers which can be used in this invention include hydrophobic acylacetamide series couplers havin a ballast group. Specific examples thereof are described in U.S. Pat. Nos. 2,407,210, 2,875,057, 3,265,506, etc. In this invention, the use of 2-equivalent yellow couplers is preferred, and typical examples thereof are the yellow couplers having oxygen atom-linked coupling-off groups described in U.S. Pat. Nos. 3,408,194, 3,447,928, 3,933,501, 4,022,620, etc., and the yellow couplers having nitrogen atom-linked coupling-off groups described in Japanese patent publication No. 10739/83, U.S. Pat. Nos. 4,401,752, 4,326,024, *Research Disclosure,* No. 18053 (April, 1979), British Pat. No. 1,425,020, West German patent application (OLS) Nos. 2,219,917, 2,261,361, 2,329,587, 2,433,812, etc. Of these yellow couplers, α-pivaloylacetanilide series couplers are excellent in fastness, particularly light fastness of the colored dyes, while on the other hand, α-benzoylacetanilide series couplers show high coloring density.

Magenta couplers contemplated for use in this invention include hydrohobic indazolone series or cyanoacetyl series, preferably 5-pyrazolone series and pyrazoloazole series couplers having a ballast group. As the 5-pyrazolone series couplers, the couplers where the 3-position is substituted by an arylamino group or an acylamino group are preferred from the viewpoint of the resulting hue and coloring density of the colored dyes. Specific examples thereof are described in U.S. Pat. Nos. 2,311,082, 2,343,703, 2,600,788, 2,908,573, 3,062,653, 3,152,896, 3,936,015, etc. Also, as the coupling-off groups for the 2-equivalent 5-pyrazolone series couplers, the nitrogen atom-linked coupling-off groups described in U.S. Pat. No. 4,310,619, and the arylthio groups described in U.S. Pat. No. 4,351,897 are particularly preferred. Also, the 5-pyrazolone series couplers having a ballast group as described in European Pat. No. 73,636 give high coloring density. The pyrazoloazole series magneta couplers may be the pyrazolobenzimidazoles described in U.S. Pat. No. 3,369,879, preferably the pyrazolo[5,1-c][1,2,4]triazoles described in U.S. Pat. No. 3,725,067, the pyrazolotetrazoles described in *Research Disclosure,* No. 24220 (June, 1984) and Japanese patent application (OPI) No. 33552/85, and the pyrazolopyrazoles described in *Research Disclosure,* No. 24230 (June, 1984) and Japanese patent application (OPI) No. 43659/85. For obtaining less yellow side absorption and high light fastness of the colored dyes, the imidazo[1,2-b]pyrazole series magenta couplers described in U.S. Pat. No. 4,500,630 are preferred, and the pyrazolo[1,5-b][1,2,4]triazole series magenta couplers described in U.S. Pat. No. 4,540,654 are particularly preferred.

The cyan couplers which can be used in this invention include hydrophobic nondiffusible naphthol series and phenol series couplers. Specific examples of the naphthol series cyan couplers are described in U.S. Pat. No. 2,474,293 (preferably the 2-equivalent naphthol series couplers having oxygen atom-linked coupling-off groups described in U.S. Pat. Nos. 4,052,212, 4,146,396, 4,228,233, and 4,296,200). Also, specific examples of the phenol series cyan couplers are described in U.S. Pat. Nos. 2,369,929, 2,801,171, 2,772,162,2,895,826, etc.

Cyan couplers having high fastness to humidity and temperature are preferred to be used in this invention, and specific examples of such cyan couplers are the phenol series cyan couplers having an alkyl group comprising 2 or more carbon atoms at the meta-position of the phenol nucleus as described in U.S. Pat. No.

3,772,002, the 2,5-diacylamino-substituted phenol series cyan couplers described in U.S. Pat. Nos. 2,772,162, 3,758,308, 4,126,396, 4,334,011, 4,327,173, West German patent application (OLS) No. 3,329,729, European Pat. No. 121,365, etc., and the phenol series cyan couplers having a phenylureido group at the 2-position and an acylamino group at the 5-position thereof as described in U.S. Pat. Nos. 3,446,622, 4,333,999, 4,451,559, 4,427,767, etc.

For correcting unnecessary light absorption of the colored dyes, it is preferred to perform masking using a colored coupler together with the aforesaid couplers for color photographic light-sensitive materials. Specific examples of the colored couplers which can be used for this purpose are the yellow-colored magenta couplers described in U.S. Pat. No. 4,163,670 Japanese patent publication No. 39413/82 and the magenta-colored cyan couplers described in U.S. Pat. Nos. 4,004,929, 4,138,258, British Pat. No. 1,146,368, etc. Other colored couplers which can be also used in this invention are described in the above-cited *Research Disclosure,* No. 17643, Section VII-G.

Also, te graininess of the color photographic material according to the present invention can be improved by using a coupler forming a colored dye having a controlled diffusibility in combination with the above-described couplers. Specific examples of such a coupler are described in U.S. Pat. No. 4,366,237 and British Pat. No. 2,125,570 for magenta couplers, and in European Pat. No. 96,570 and West German patent application (OLS) No. 3,234,533 for yellow, magenta, and cyan couplers.

The dye-forming coupler or the above-described specific couplers may form a dimer or a higher molecular weight polymer. Specific examples of these polymerized couplers are described in U.S. Pat. Nos. 3,451,820 and 4,080,211. Also, specific examples of the polymerized magenta couplers are described in British Pat. No. 2,102,173 and U.S. Pat. No. 4,367,282.

A coupler releasing a photographically useful residue upon undergoing a coupling reaction can be preferably used in this invention. As DIR couplers releasing a development inhibitor, the couplers described in the patents cited in Section VII-F of the above-cited *Research Disclosure,* No. 17643 are useful.

Preferred examples of the DIR couplers which can be used in combination with the couplers of this invention are the developer inactivating type DIR couplers described, for example, in Japanese patent application (OPI) No. 151944/82, the timing type DIR couplers described in U.S. Pat. No. 4,248,962 and Japanese patent application (OPI) No. 154234/82, the reaction type DIR couplers described in Japanese patent application No. 39653/84 (corresponding to Japanese patent application (OPI) No. 184248/85). Particularly preferred are the developer inactivating type DIR couplers described in Japanese patent application (OPI) Nos. 151944/82, 217932/83, Japanese patent application Nos. 75474/83, 82214/84 and 90438/84 (corresponding to Japanese patent application (OPI) Nos. 218644/85, 225156/85 and 233650/85, respectively), and the reaction type DIR couplers described in Japanese patent application No. 39653/84 (corresponding to Japanese patent application (OPI) No. 184248/85), etc.

Supports which can be used for the photographic light-sensitive materials of this invention are described, for example, in *Research Disclosure,* No. 17643, page 28 and *Research Disclosure,* No. 18716, page 647, right column to page 648, left column.

The color photographic materials of this invention can be processed by conventional processes as described, for example, in *Research Disclosure,* No. 17643, pages 28 and 29 and *Research Disclosure,* No. 18716, page 651, left column to right column.

The color photographic materials of this invention are usually subjected to wash treatment or stabilization treatment after developing and bleach-fixing or fixing.

The wash step is generally performed in a counter-current system using two or more baths for saving water. A typical stabilization treatment which can be applied in place of washing is the multistage counter-current type stabilization treatment described in Japanese patent application (OPI) No. 8543/82. Where employing this stabilization process, 2 to 9 counter-current baths are required. To the stabilization bath(s) are added various additives for stabilizing images. Examples of these additives are various buffers for controlling pH (e.g., pH 3 to 8) of layers (e.g., a borate, a metaborate, borax, a phosphate, a carbonate, potassium hydroxide, sodium hydroxide, aqueous ammonia, a monocarboxylic acid, dicarboxylic acid, polycarboxylic acid, etc., used either singly or as a combiantion thereof), formalin, etc. Other examples of these additives, which can be used, if necessary, are water softeners (inorganic phosphoric acids, aminopolycarboxylic acids, organic phosphoric acids, aminopolyphosphonic acids, phosphonocarboxylic acids, etc.), sterilizers (e.g., benzoisothiazolinone, isothiazolone, 4-thiazoline-benzimidazole, halogenated phebols, etc.), surface active agents, brightening agents, hardening agents, etc. These various additives can be used alone or as a mixture thereof.

Also, it is preferred to use an ammonium salt such as ammonium chloride, ammonium nitrate, ammonium sulfate, ammonium phosphate, ammonium sulfite, ammonium thiosulfate, etc., as a film pH adjusting agent after processing.

This invention can be applied to various kinds of color photographic materials or black-and-white photographic materials. For example, there are general or cinne black-and-white negative photographic films, black-and-white photographic papers, lithographic light-sensitive films, X-ray photographic films, color photographic negative films, color reversal photographic films for slides or televisions, color photographic papers, color photographic positive films, and color reversal photographic papers. This invention can be also applied to the black-and-white light-sensitive materials utilizing a mixture of three colors as described in *Research Disclosure,* No. 17123 (July, 1978).

The nondiffusable photographically useful compounds for use in this invention can additionally be applied to heat-developable light-sensitive materials or high temperature development type light-sensitive materials, such as those described in U.S. Pat. No. 4,500,626, Japanese patent application (OPI) Nos. 133449/85 and 218443/84, etc.

The following examples will serve to illustrate this invention, but they are not to be construed as limiting the present invention in any manner. Unless otherwise indicated, all parts, percents, ratios and the like are by weight.

EXAMPLE 1

Sample 101 was prepared by forming, in succession, a silver halide emulsion layer and a protective layer having the compositions shown below on a cellulose acetate film support.

Emulsion Layer

| | |
|---|---|
| Silver Iodobromide Emulsion (silver iodide: 6 mol %, mean grain size: 0.6 μm) | 0.018 mol/m$^2$ as silver coverage |
| Sensitizing Dye I* | $1.5 \times 10^{-4}$ mol per mol of Ag |
| Sensitizing Dye II | $3.8 \times 10^{-5}$ mol per mol of Ag |
| Coupler A | 0.05 mol per mol of Ag |
| Coupler R (1) | 0.01 mol per mol of Ag |
| Di-n-Butyl Phthalate | 1 g per g of the couplers |

*The chemical structures of the specific compounds used in this example are shown hereafter.

In a mixed solvent comprising 7 g of di-n-butyl phthalate, 15 ml of ethyl acetate and 10 ml of water were dissolved 5 g of Coupler A and 2 g of Coupler R (1) with heating, followed by dispersing. The water-drop-in-oil type dispersion thus obtained was dispersed in 100 ml of an aqueous 10% gelatin solution using a homogenizer. The emulsified dispersion thus obtained was then added to a mixture of the silver halide emulsion and the sensitizing dyes, and the resulting mixture was coated on the above-described film support to form the emulsion layer.

Protective Layer

A gelatin layer containing gelatin, Gelatin Hardening Agent H-1, and sodium di(2-ethylhexyl)sulfo-succinate was formed and coated on the emulsion layer.

Also, Sample 102 was prepared in the same manner as Sample 101 except that Coupler R (2) was used in place of Coupler R (1).

Sample 103 was prepared by following the same procedure as Sample 101 except that Coupler (7) of the present invention was used in place of Coupler R (1).

Sample 104 was prepared by following the same procedure as Sample 101 except that Coupler (2) of the present invention ws used in place of Coupler R (1).

Each of Samples 101 to 104 thus prepared were imagewise exposed and then processed as follows at 38° C.

| | |
|---|---|
| Color Development | 3 min 15 sec |
| Bleaching | 6 min 30 sec |
| Washing | 2 min 10 sec |
| Fixing | 4 min 20 sec |
| Washing | 3 min 15 sec |
| Stabilization | 1 min 5 sec |

The compositions of the processing solutions used for the above processing steps were as follows.

| | |
|---|---|
| Color Developer: | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N—Ethyl-N—β-hydroxyethylamino)-2-methylaniline Sulfate | 4.5 g |
| Water to make | 1.0 liter |
| | pH 10.0 |
| Bleaching Solution: | |
| Ammonium Ethylenediaminetetraacetato Ferrate | 100.0 g |
| Ethylenediaminetetraacetic Acid Disodium Salt | 10.0 g |
| Ammonium Bromide | 150.0 g |
| Ammonium Nitrate | 10.0 g |
| Water to make | 1.0 liter |
| | pH 6.0 |
| Fixing Solution: | |
| Ethylenediaminetetraacetic Acid Disodium Salt | 1.0 g |
| Sodium Sulfite | 4.0 g |
| Aqueous Ammonium Thiosulfate Solution (70%) | 175.0 ml |
| Sodium Hydrogensulfite | 4.6 g |
| Water to make | 1.0 liter |
| | pH 6.6 |
| Stabilization Solution: | |
| Formalin (40%) | 2.0 ml |
| Polyoxyethylene-p-monononylphenyl Ether (average polymerization degree of 10) | 0.3 g |
| Water to make | 1.0 liter |

For each of the samples thus processed, a comet number caused by the existence of microscopic insoluble matters in coupler(s) and the maximum coloring density $D_m$ were measured, and the results obtained are shown in Table 1 below.

A description of the comet number are described in B. M. Deryagin et al., *Film Coating Theory*, page 183 (The Focal Press, 1964). The comet number is the number of comets having a diameter of at least 100 μm per 1 dm$^2$ when the surface of a light-sensitive material is observed under a microscope. The allowable comet number for practical use is at most about 10/dm$^2$.

TABLE 1

| Sample No.* | Comet Numbers (per dm$^2$) | Relative Sensitivity |
|---|---|---|
| 101 | At least 1,000 | Unmeasurable |
| 102 | Up to 10 | 100 |
| 103 | " | 146 |
| 104 | " | 157 |

*Samples 101 and 102: Comparative samples
Samples 103 and 104: Samples of this invention The couplers used for the comparative samples in this example, the hardening agent used and the sensitizing dyes employed are as follows.

Coupler A

-continued

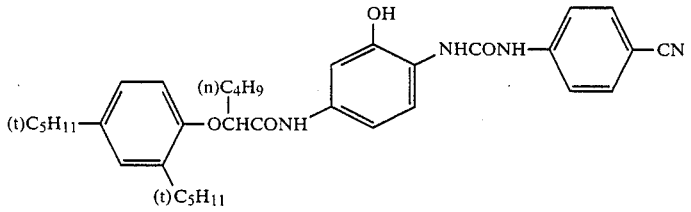

Coupler R (1)

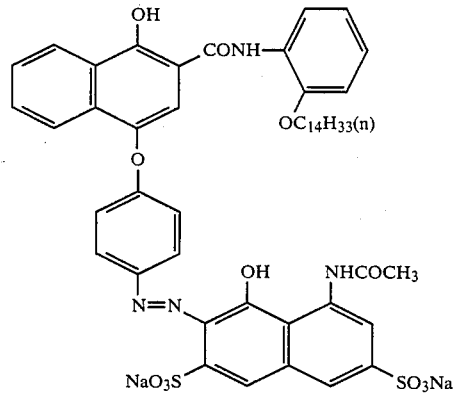

Coupler R (2)

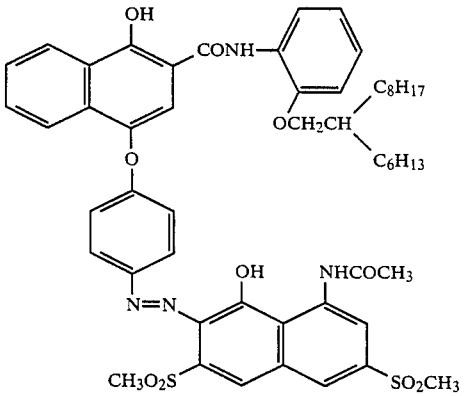

(U.S. Pat. No. 3,892,576)

Gelatin Hardening Agent H-1

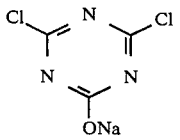

As is clear from the results shown in Table 1, when the colored couplers according to this invention are used, good dispersibility is observed, and the color photographic materials using the colored couplers show excellent photographic properties.

EXAMPLE 2

A multilayer color photographic light-sensitive material (Sample 201) was formed having the layers comprising the following compositions coated on a cellulose tricetate film support.

Layer 1

Antihalation Layer

A gelatin layer containing black colloidal silver.

Layer 2

Interlayer

A gelatin layer.

Layer 3

First Red-Sensitive Emulsion Layer

| | |
|---|---|
| Silver iodobromide emulsion (silver iodide: 6 mol %, mean grain size: 0.6 μm) | 0.023 mol/m$^2$ as silver coverage |
| Sensitizing Dye I | $1.5 \times 10^{-4}$ mol per mol of Ag |
| Sensitizing Dye II | $3.8 \times 10^{-5}$ mol per mol of Ag |
| Coupler A | 0.05 mol per mol of Ag |
| Coupler (2) | 0.003 mol per mol of Ag |
| Coupler B | 0.002 mol per mol of Ag |
| Di-n-Butyl Phthalate | 1.0 g per g of the couplers |

Coupler A, Coupler (2), Coupler B, and di-n-butyl phthalate were dispersed by emulification in the same manner as in Example 1, the emulsified dispersion was then mixed with the silver halide emulsion, and the mixture was coated on the interlayer (Layer 2).

Layer 4

Second Red-Sensitive Emulsion Layer

| | |
|---|---|
| Silver Iodobromide Emulsion (silver iodide: 8 mol %, mean grain size: 1.0 μm) | 0.011 mol/m$^2$ as silver coverage |
| Sensitizing Dye I | $1.5 \times 10^{-4}$ mol per mol of Ag |
| Sensitizing Dye II | $3.8 \times 10^{-5}$ mol per mol of Ag |
| Coupler C | 0.02 mol per mol of Ag |
| Coupler (2) | 0.002 mol per mol of Ag |
| Di-n-Butyl Phthalate | 1.0 g per g of the couplers |

Coupler C, Coupler (2) and di-n-butyl phthalate were mixed with the silver halide emulsion as described above for Layer 3 and the mixture was coated on Layer 3.

Layer 5

Interlayer

A gelatin layer containing $2.2 \times 10^{-4}$ mol/m$^2$ of 2,5-di-t-octylhydroquinone and tricresyl phosphate.

Layer 6

First Green-Sensitive Emulsion Layer

| | |
|---|---|
| Silver Iodobromide Emulsion (silver iodide: 6 mol %, mean grain size: 0.6 μm) | 0.011 mol/m$^2$ as silver coverage |
| Sensitizing Dye III | $3 \times 10^{-4}$ mol per mol of Ag |
| Sensitizing Dye IV | $1 \times 10^{-4}$ mol per mol of Ag |
| Coupler D | 0.09 mol per mol of Ag |
| Coupler E | 0.03 mol per mol of Ag |
| Coupler F | 0.01 mol per mol of Ag |
| Tricresyl Phosphate | 1.5 g per g of the couplers |

Layer 7

Second Green-Sensitive Emulsion Layer

| | |
|---|---|
| Silver Iodobromide Emulsion (silver iodide: 8 mol %, mean grain size: 1.0 μm) | 0.009 mol/m$^2$ as silver coverage |
| Sensitizing Dye III | $3 \times 10^{-4}$ mol per mol of Ag |
| Sensitizing Dye IV | $1 \times 10^{-4}$ mol per mol of Ag |
| Coupler G | 0.01 mol per mol of Ag |
| Coupler H | 0.01 mol per mol of Ag |
| Coupler E | 0.006 mol per mol of Ag |
| Tricresyl Phosphate | 1.5 g per g of the couplers |

Layer 8

Yellow Filter Layer

A gelatin layer containing yellow colloidal silver, 2,5-di-t-octylhydroquinone, and tricresyl phosphate.

Layer 9

First Blue-Sensitive Emulsion Layer

| | |
|---|---|
| Silver Iodobomide Emulsion (silver iodide: 6 mol %, mean grain size: 0.7 μm) | 0.014 mol/m$^2$ as silver coverage |
| Coupler I | 0.25 mol per mol of Ag |
| Coupler J | 0.002 mol per mol of Ag |
| Tricresyl Phosphate | 0.5 g per g of the couplers |

Layer 10

Second Blue-Sensitive Emulsion Layer

| | |
|---|---|
| Silver Iodobromide Emulsion (silver iodide: 8 mol %, mean grain size: 1.2 μm) | 0.010 mol/m$^2$ as silver coverage |
| Coupler J | 0.06 mol per mol of Ag |
| Tricresyl Phosphate | 0.5 g per g of the couplers |

Layer 11

First Protective Layer

A gelatin layer containing a silver iodobromide fine grain emulsion (silver iodide: 1 mol%, mean grain size: 0.07 μm) at a silver coverage of 0.5 g/m$^2$ and an emulsified dispersion of Ultraviolet Absorbent UV-1 and tricresyl phosphate.

Layer 12

Second Protective Layer

A gelatin layer containing polymethyl methacrylate particles (diameter: about 1.5 μm).

The couplers in each of the above-described emulsion layers (except for the red-sensitive emulsion layers) were dissolved in a mixed solvent comprising the above-described high boiling solvent and ethyl acetate by heating, and the resulting solution was then mixed with an aqueous 10% gelatin solution containing sodium p-dodecylbenzenesulfonate as an emulsifier, and the mixture was emulsified by a colloid mill before coating.

Each layer further contained Gelatin Hardening Agent H-2 and a surface active agent in addition to the above-described components.

The compounds used for making the test sample were as follows (Sensitizing Dyes I and II were also used in Example 1).

Sensitizing Dye I

Anhydro-5,5'-dichloro-3,3'-di(γ-sulfopropyl)-9-ethylthiacarbocyanine hydroxide pyridinium salt.

Sensitizing Dye II

Anhydro-9-ethyl-3,3'-di(γ-sulfopropyl)-4,5,4',5'-dibenzothiacarbocyanine hydroxide triethylamine salt.

Sensitizing Dye III

Anhydro-9-ethyl-5,5'-dichloro-3,3'-di(γ-sulfopropyl-)oxacarbocyanine sodium salt.

Sensitizing Due IV

Anhydro-5,6,5',6'-tetrachloro-1,1'-diethyl-3,3'-di{β-[β-(γ-sulfopropyl)ethoxy]ethylimidazolo-carbocyanine} hydroxide sodium salt.

Coupler B

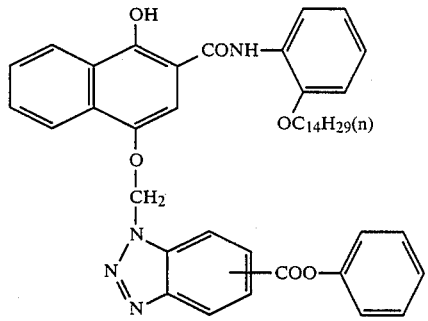

Coupler C

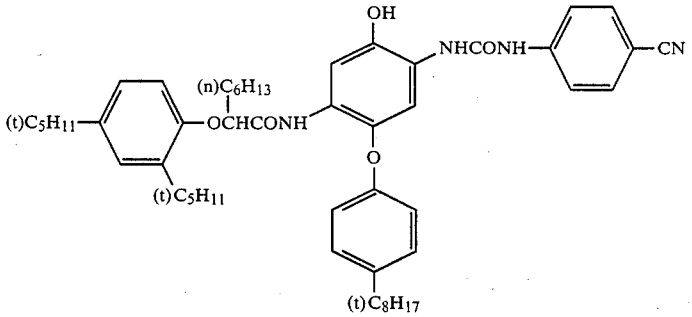

Coupler D

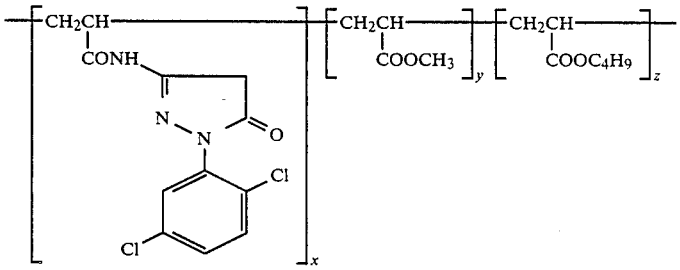

x,y,z = 50/25/25 (weight ratio)

Coupler E

-continued
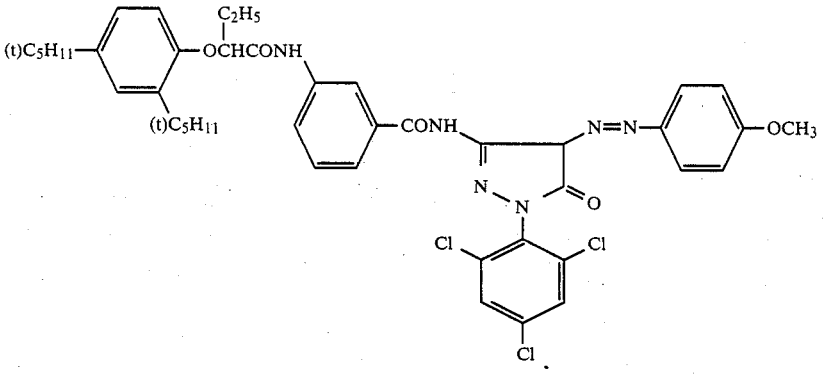
Coupler F
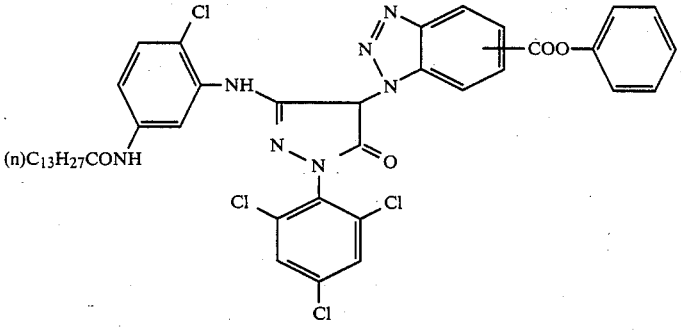
Coupler G
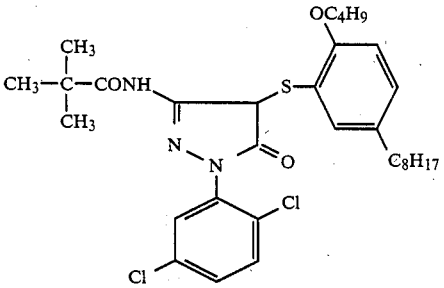
Coupler H
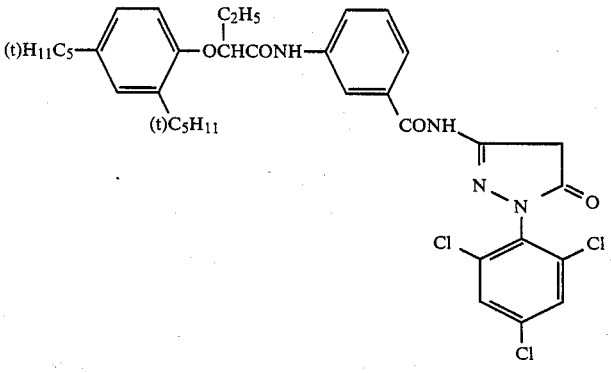
Coupler I -continued

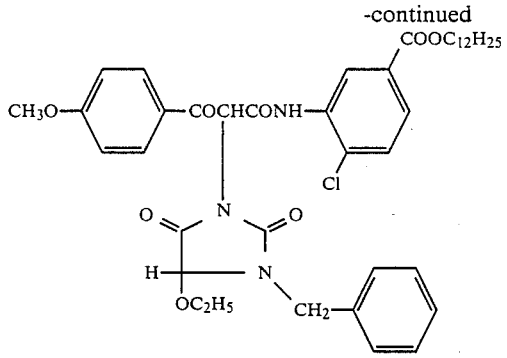

Coupler J

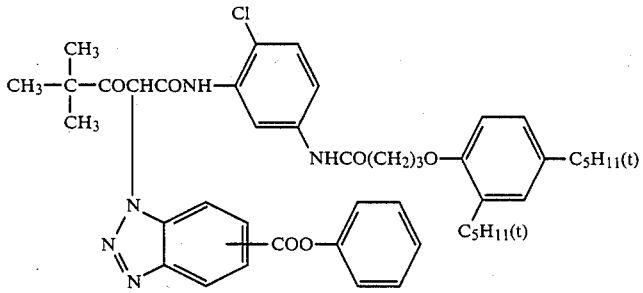

Ultraviolet Absorbent UV-1

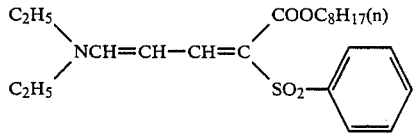

Gelatin Hardening Agent H-2

$$CH_2{=}CHSO_2CH_2CONHCH_2CH_2NHCOCH_2SO_2CH{=}CH_2$$

Sample 201 thus obtained showed no coating defects. Also, when Sample 201 was imagewise exposed to white light and processed as in Example 1, Sample 201 showed excellent sensitivity and gradation. Furthermore, the negative film obtained by imagewise exposing Sample 201 by red light and developing it as in Example 1 was printed on Fuji High Tech Color Paper 12 (trade name, made by Fuji Photo Film Co., Ltd.), the film showed very good color reproducibility.

EXAMPLE 3

Samples 301 to 305 were prepared by following the same procedure as in Example 2 except that the couplers used for the red-sensitive emulsion layers of Sample 201 were changed as shown in Table 2 below.

The comparative couplers other than the couplers shown in Example 1 and Example 2 were as follows:

Coupler R (3)

-continued

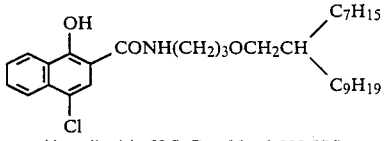

(described in U.S. Pat. No. 3,892,576)

Coupler R (4)

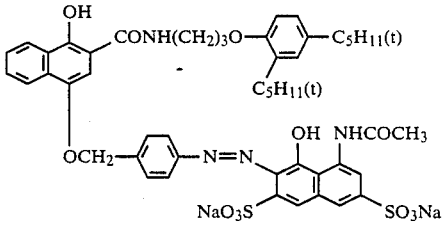

(described in U.S. Pat. No. 4,138,258)

Each of the samples thus obtained were image-wise exposed and processed as in Example 1, and the relative sensitivity of each sample thus processed was measured. The results obtained are shown in Table 2 below.

TABLE 2

| Sample No. | Coupler for First Red-Sensitive Emulsion Layer: Main Coupler | Colored Coupler | DIR Coupler | Coupler for Second Red-Sensitive Emulsion Layer: Main Coupler | Colored Coupler | Relative Sensitivity |
|---|---|---|---|---|---|---|
| 201 | A | (2) | B | C | (2) | 100 |
| 301 | A | (11) | B | (10) | (13) | 118 |
| 302 | A | (2) | (19) | (10) | (2) | 108 |
| 303 | (6) | R (4) | B | (6) | R (4) | 112 |
| 304 | R (3) | R (4) | B | R (3) | R (4) | 78 |
| 305 | A | R (4) | B | C | R (4) | 86 |

From the results shown in Table 2, it can be clearly seen that the couplers as defined according to the present invention as the photographically useful compounds show high reactivity with the oxidation product of a developing agent and, hence, the color photographic materials using these couplers show very high relative sensitivities.

As described above, the silver halide color photographic materials of this invention using the photographically useful compounds defined according to the present invention show excellent photographic performance, whereby the object of this invention can be attained. Specifically, the couplers defined in this invention can be easily dispersed by emulsification and the coating composition containing such a coupler can be stably coated on a support without causing any coating defects. Furthermore, the couplers show high reactivity with the oxidation product of a developing agent, which results in the formation of high speed color photographic materials.

When the reactivity of the main couplers (color image-forming couplers) is high, it is preferred that the reactivity of colored couplers and/or DIR couplers which are used together with the main couplers is also high. This is because in such a case, a uniform color correction and/or development inhibition is performed, and photographic images having excellent sharpness are obtained with good color reproducibility. That is, the DIR couplers and colored couplers defined in this invention can be preferably used as these compounds in combination with the main couplers having high reactivity.

It is considered that the excellent effects seen by use of this invention are obtained by using the photographically useful compounds defined according to the present invention (having a sulfo group having good hydrophilic properties and a branched type aliphatic group having good oleophilic properties and which are less likely to aggregate or crystallize). It is also considered that the photographically useful compounds defined in this invention do not exist in a high boiling dispersing solvent or a hydophilic medium such as gelatin, etc., in a completely separated state, but rather exist in both the solvent and the hydrophilic medium or at the interface thereof simultaneously. This feature of the compounds defined in this invention is thought to account for the superior effects clearly seen when using silver halide photographic materials according to the present invention. In other words, the compounds defined in this invention have a wide range applicability and, further, not only can strongly exhibit the individual functions of each photographically useful compound defined in accordance with this invention, but also result in stable dispersion and stable coating of the photographic layers.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having coated thereon at least one silver halide emulsion layer and at least one hydrophilic colloid layer, wherein at least one of said silver halide emulsion layer and said hydrophilic colloid layer contains a non-diffusible photographically useful compound represented by the following general formula (III), (IV), or (V):

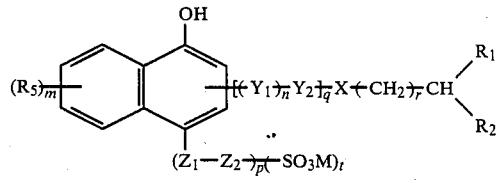
(III)

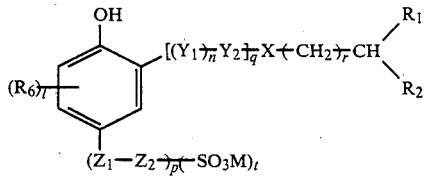
(IV)

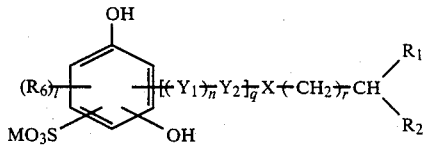
(V)

wherein $R_1$ and $R_2$ each represents an aliphatic group having at least 2 carbon atoms; r represents 0 or 1; X represents —O—, —S—, $$-COO-,\ -SO_2O-,\ -\underset{\underset{R_3}{|}}{CON}-,\ -\underset{\underset{R_3}{|}}{SO_2N}-,$$

$$-SO_2-,\ -\underset{\underset{R_3}{|}}{NCOO}-,\ -\underset{\underset{R_3}{|}}{N}\underset{\underset{R_4}{|}}{CON}-,\ \text{or}\ -\underset{\underset{R_3}{|}}{N}-$$

(wherein $R_3$ and $R_4$ each represents a hydrogen atom or an aliphatic group having 1 to 30 carbon atoms), or a chemical bond; M represents a hydrogen atom or a cation; t represents an integer of from 1 to 3; $Y_1$ is the same as X; $Y_2$ represents a divalent aliphatic group or a divalent aromatic group; n represents 0 or 1; q represents 0, 1 or 2; when q is 2, $Y_1$ and $Y_2$ may be the same or different; $Z_1$ represents —O—, —S—, —N=N— or

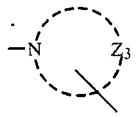

(wherein $Z_3$ represents an organic atomic group necessary for forming a 5-membered or 6-membered nitrogen-containing heterocyclic ring); $Z_2$ represents an aliphatic group or an aromatic group; p represents an integer of 1 to 3; when p is 2 or 3, $Z_1$ and $Z_2$ may be the same or different; $R_5$ represents a group substituted at the atomatic ring; m respresents 0 to 4; when m is more than 1, $R_5$ may be the same or different; $R_6$ represents a group substituted at the aromatic ring; and λ represents 0, 1 or 2; when λ is 2, $R_6$ may be the same or different, and wherein the sum of the carbon atoms contained in said formula

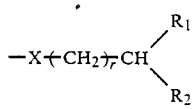

is in the range of 14 to 30.

2. A silver halide photographic material as claimed in claim 1, wherein q and n in the general formulae (III) and (IV) are 1.

3. A silver halide photographic material as claimed in claim 1, wherein $Y_1$ in the general formula (III) is —CONH—.

4. A silver halide photographic material as claimed in claim 1, wherein $Y_1$ in the general formula (IV) is —NHCO— or —NHCONH—.

5. A silver halide photographic material as in claim 1, wherein m in the general formula (III) is 0 or 1.

6. A silver halide photographic material as claimed in claim 5, wherein the position to which $R_5$ is substituted is the 5-position of the naphthol ring.

7. A silver halide photographic material as claimed in claim 1, wherein $Z_2$ to which (t)$SO_3M$ group are bonded in the general formulae (III) and (IV) is an aromatic group.

8. A silver halide photographic material as claimed in claim 1, wherein X in the general formulae (III), (IV) and (V) is —O—, —S—, —NHCO—, —OCO— or —COO—.

* * * * *